US005821902A

United States Patent [19]

Keen

[11] Patent Number: 5,821,902

[45] **Date of Patent: *Oct. 13, 1998**

[54] FOLDED DIPOLE MICROSTRIP ANTENNA

[75] Inventor: Keith M. Keen, Billingshurst, England

[73] Assignee: Inmarsat, England

[ * ] Notice: The term of this patent shall not extend beyond the expiration date of Pat. No. 5,539,414.

[21] Appl. No.: 535,380

[22] Filed: Sep. 28, 1995

Related U.S. Application Data

[63] Continuation of Ser. No. 116,243, Sep. 2, 1993, Pat. No. 5,539,414.

[51] Int. Cl.[6] ..... H01Q 1/38; H01Q 9/26

[52] U.S. Cl. ..... 343/700 MS; 343/702; 343/803

[58] Field of Search ..... 343/700 MS, 793, 343/794, 795, 702, 803

[56] References Cited

U.S. PATENT DOCUMENTS

| | | | |
|---|---|---|---|
| 3,813,674 | 5/1974 | Sidford | 343/803 |
| 4,084,162 | 4/1978 | Dubost et al. | 343/700 MS |
| 4,426,649 | 1/1984 | Dubost et al. | 343/803 |
| 4,498,085 | 2/1985 | Schwarzmann | 343/795 |
| 4,817,196 | 3/1989 | MacNak et al. | 455/193 |
| 4,862,516 | 8/1989 | Macnak et al. | 455/193 |
| 4,873,527 | 10/1989 | Tan | 343/718 |
| 4,899,162 | 2/1990 | Bayetto et al. | 343/700 MS |
| 4,980,694 | 12/1990 | Hines | 343/702 |
| 4,992,799 | 2/1991 | Garay | 343/702 |
| 5,289,198 | 2/1994 | Altshuler | 343/729 |
| 5,410,749 | 4/1995 | Siwiak et al. | 343/700 MS |
| 5,539,414 | 7/1996 | Keen | 343/700 MS |

FOREIGN PATENT DOCUMENTS

| | | | |
|---|---|---|---|
| 0 331 486 | 9/1989 | European Pat. Off. . | |
| 0 531 164 | 3/1993 | European Pat. Off. . | |
| 26 21 452 | 11/1976 | Germany | 343/803 |
| 85/02719 | 6/1985 | WIPO . | |

OTHER PUBLICATIONS

Conformal Microstrip Antennas, Robert E. Munson, Microwave Journal, Mar. 1988.

Theory And Applications Of Broadband Microstrip Antennas, G. Dubost et al., pp. 275–279, 6th European Microwave Conference, 1976.

Array Elements For A DBS Flat–Plate Antenna, M. C. D. Maddocks, BBC Research Department Report, Jul. 1988.

*Primary Examiner*—Hoanganh T. Le
*Assistant Examiner*—Tan Ho
*Attorney, Agent, or Firm*—Banner & Witcoff, Ltd.

[57] ABSTRACT

A folded dipole microstrip antenna is disclosed herein. The microstrip antenna includes a dielectric substrate for defining a first mounting surface and a second mounting surface substantially parallel thereto. A folded dipole radiative element is mounted on the second mounting surface. The microstrip antenna further includes a microstrip feed line, mounted on the first surface, for exciting the radiative element in response to an excitation signal. In a preferred implementation of the microstrip antenna an excitation signal is applied to the microstrip feed line through a coaxial cable. In such a preferred implementation the folded dipole radiative element includes a continuous dipole arm arranged parallel to first and second dipole arm segments separated by an excitation gap. The feed element is mounted in alignment with the excitation gap and is electrically connected to the continuous dipole arm. The antenna may additionally include a ground plane reflector separated from the folded dipole radiative element by a dielectric spacer for projecting, in a predetermined direction, electromagnetic energy radiated by the folded dipole radiative element. The thickness of the dielectric spacer between the ground plane reflector and the folded dipole radiative element is selected such that the impedance presented by the antenna to the coaxial cable is approximately fifty ohms.

4 Claims, 3 Drawing Sheets

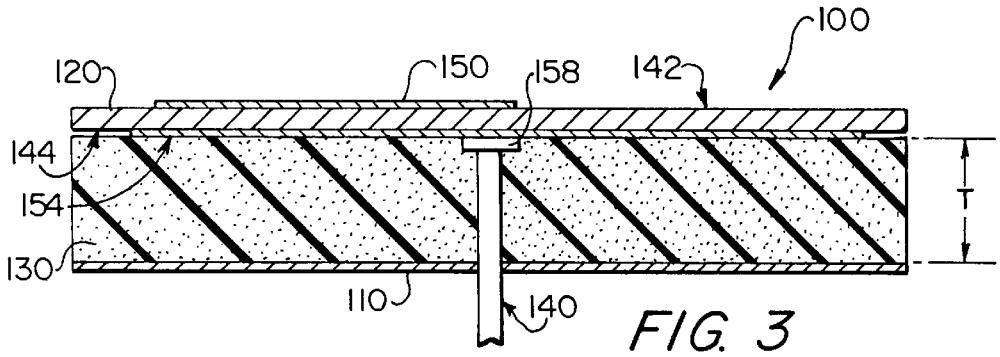
FIG. 3
FIG. 4
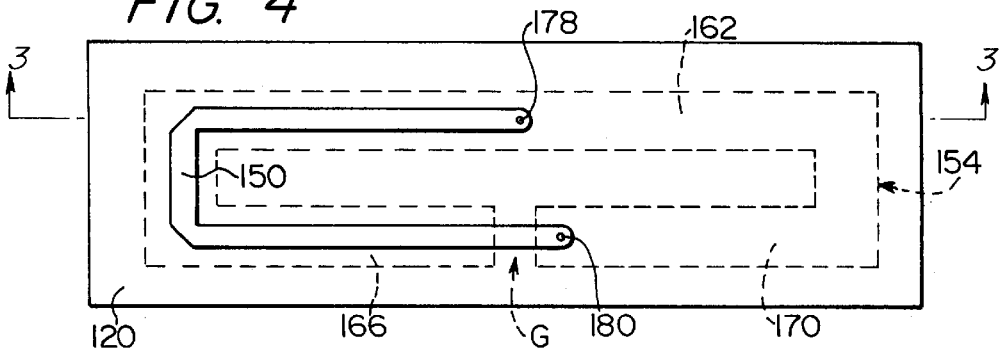
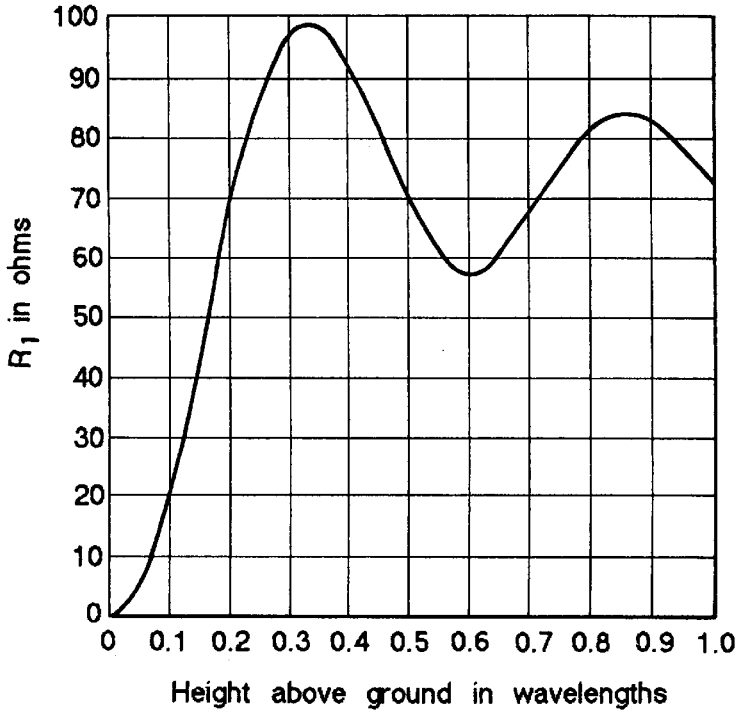
FIG. 6

FOLDED DIPOLE MICROSTRIP ANTENNA

This application is a continuation of application Ser. No. 08/116,243, filed Sep. 2, 1993, now U.S. Pat. No. 5,539,414.

The present invention relates to the field of microstrip antennas, and particularly to microstrip antennas used in miniature portable communications devices.

BACKGROUND OF THE INVENTION

In the design of portable radio equipment, and in particular personal paging devices, size is an extremely important factor. Many previous paging devices employed relatively large receive antennas, thereby significantly increasing overall device dimensions. Antennas of this scale were generally required as a consequence of the use of relatively low RF paging frequencies, and also so as to ensure adequate reception of the paging signals. Specifically, high antenna gain is desirable, and under certain conditions may in fact be necessary to ensure achievement of full receiver range capability. However, size constraints preclude incorporation of conventional high gain antenna configurations into paging receivers designed to be relatively compact.

The large size of many conventional paging receivers has required that they be mounted on the side of the body, usually through attachment to the belt or through placement in a pocket. Recently, however, it has been desired to realize paging devices sufficiently compact to be, for example, worn on the wrist. One advantage offered by wrist-carried paging receivers is that they may be held in front of the face, thereby facilitating viewing or adjustment by the user.

Existing wrist-carried paging receivers often include simple loop type antennas responsive to the magnetic field component of the RF signal. In such antennas the loop element is generally disposed within the wrist band of the user. Although this type of antenna system has tended to provide only marginal performance, it enables the loop antenna to be concealed within the wrist band housing. However, this arrangement is of advantage only if it is desired that the attachment mechanism consist of a wrist band or other loop-type device. Accordingly, it would be desirable to provide an antenna system which is capable of being implemented within a paging receiver of compact dimension, and which does not presuppose a particular type of attachment mechanism.

As noted above, receive antennas incorporated within conventional terrestrial paging devices have tended to be somewhat large, partially as a consequence of the use of relatively low paging frequencies (e.g., <1 GHz). However, existing satellite communications systems operative at, for example, 1.5 or 2.5 GHz, afford the opportunity for paging receiver antennas of smaller scale. Antennas operative at these frequencies would need to have gains sufficiently low to project broad radiation patterns, thus enabling reception of paging signals from a broad range of angles. This is required since terrestrial reception of satellite signals is based not only upon line-of-sight transmissions, but also upon transmissions scattered and reflected by objects such as buildings, roads, and the like. Hence, it is an object of the present invention to provide a compact antenna capable of receiving paging signals from communication satellites.

SUMMARY OF THE INVENTION

In summary, the present invention comprises a folded dipole microstrip antenna. The microstrip antenna includes a dielectric substrate for defining a first mounting surface and a second mounting surface substantially parallel thereto.

A folded dipole radiative element is mounted on the second mounting surface. The microstrip antenna further includes a microstrip feed line, mounted on the first surface, for exciting the radiative element in response to an excitation signal.

In a preferred embodiment of the microstrip antenna an excitation signal is applied to the microstrip feed line through a coaxial cable. In such a preferred embodiment the folded dipole radiative element includes a continuous dipole arm arranged parallel to first and second dipole arm segments separated by an excitation gap. The feed element is mounted in alignment with the excitation gap and is electrically connected to the continuous dipole arm. The antenna may additionally include a ground plane reflector for projecting, in a predetermined direction, electromagnetic energy radiated by the folded dipole radiative element, as well as for effecting an impedance match between the antenna and a 50 ohm transmission line system.

BRIEF DESCRIPTION OF THE DRAWINGS

Additional objects and features of the invention will be more readily apparent from the following detailed description and appended claims when taken in conjunction with the drawings, in which:

FIG. 3 depicts a preferred implementation of the folded dipole antenna in greater detail, providing a cross-sectional view from which the housing has been omitted for clarity.

FIG. 4 shows a partially see-through top view of a preferred embodiment of the folded dipole antenna.

FIG. 6 is a graph showing the driving point resistance at the center of a horizontal ½ wavelength antenna as a function of the height thereof above a ground plane.

DESCRIPTION OF THE PREFERRED EMBODIMENT

Figure 1:
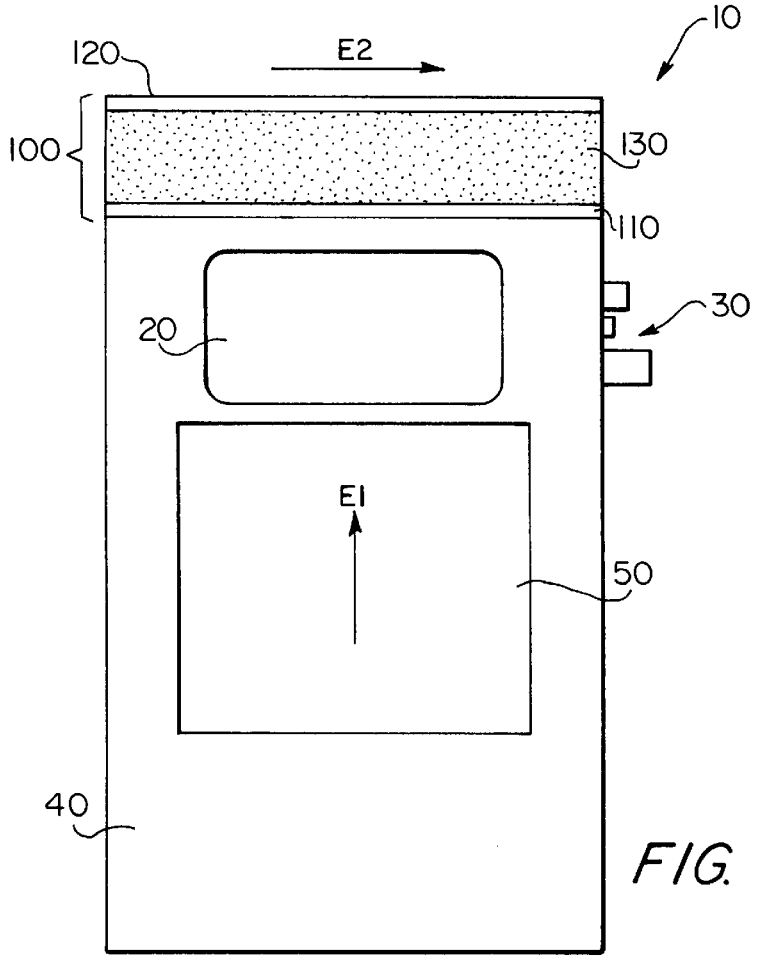
FIG. 1 shows a personal paging receiver in which is incorporated the folded dipole antenna system of the present invention.

Referring to FIG. 1, there is illustrated a personal paging receiver in which is incorporated the folded dipole antenna system of the present invention. The paging receiver designated generally as 10 includes a display 20 and input switches 30 for operating the paging receiver in a manner well known to those of ordinary skill in the art. The receiver 10 is disposed within a housing 40, a lateral side of which provides a surface for mounting an auxiliary microstrip patch antenna 50. In addition, the housing 40 defines a first end surface on which is mounted the folded dipole antenna 100 of the present invention. As is indicated by FIG. 1, the auxiliary patch antenna 50 is designed to project a radiation pattern having an electric field orientation E1 transverse to the electric field orientation E2 of the inventive dipole antenna 100. This combination of antennas facilitates improved reception of paging signals of diverse polarization and angle of incidence. In an exemplary implementation the folded dipole antenna 100 is designed to receive paging signals broadcast via satellite at a frequency of 1542 MHz.

Figure 2:
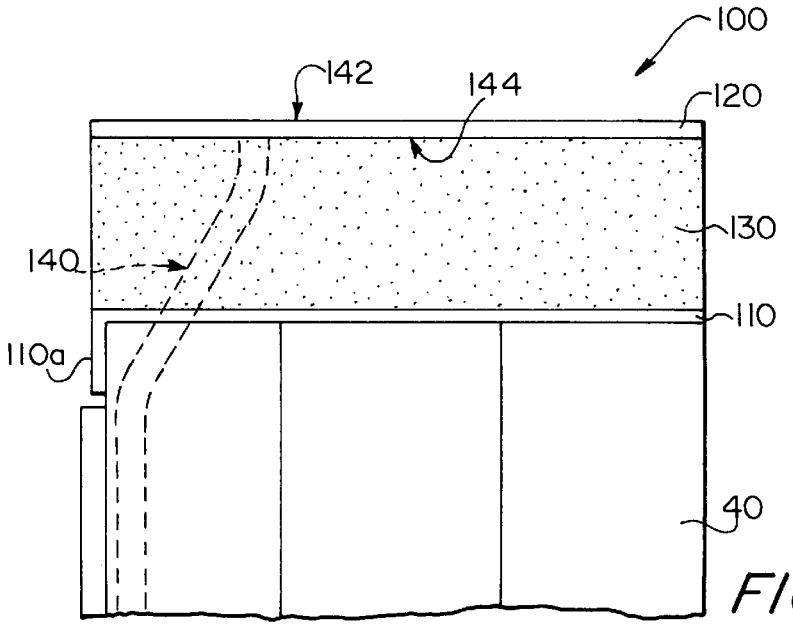
FIG. 2 provides an illustration of the microstrip structure of the inventive folded dipole antenna.

As shown in FIGS. 1 and 2, the inventive folded dipole antenna 100 is implemented using a microstrip structure comprising an antenna ground plane 110, a microstrip laminate board 120, and a foam spacer 130 interposed therebetween. The antenna 100 will generally be attached to the housing 40 by gluing the ground plane 110 thereto using, for example, a hot-melt plastic adhesive. The ground plane 110 may be fabricated from a metallic sheet having a thickness within the range of 0.5 to 2.0 mm, and includes an external segment 110*a* for connection to a lateral side of the housing 40. The foam spacer 130 may be fabricated from, for example, polystyrene foam having a dielectric constant of approximately 1.2. The thickness of the foam spacer 130 is selected in accordance with the desired impedance, typically 50 ohms, to be presented by the antenna 100 to a coaxial cable 140 (FIG. 2).

Referring to FIG. 2, the cable 140 extends from receive electronics (not shown) into the foam spacer 130 through a slot defined by the ground plane 110. As is described below, the inner and outer conductors of the coaxial cable 140 are connected, using a conventional coaxial-to-microstrip transition, to printed microstrip circuit elements disposed on the upper and lower surfaces 142 and 144, respectively, of the laminate board 120. In a preferred embodiment the microstrip laminate board comprises a Duroid sheet, typically of a thickness between 1 and 2 mm, produced by the Rogers Corporation of Chandler, Ariz. Microstrip substrates composed of other laminate materials, e.g., alumina, may be utilized within alternative embodiments of the folded dipole antenna.

FIG. 3 illustrates the folded dipole antenna 100 in greater detail, providing a cross-sectional view from which the housing 40 has been omitted for clarity. As shown in FIG. 3, a feeder line 150 comprising microstrip circuit elements is printed on the uppersurface 142 of the microstrip laminate board 120. In addition, a folded microstrip dipole element 154 is printed on the lower surface 144 of the board 120. In an exemplary embodiment the center conductor of the coaxial cable 140 extends through the laminate board 120 into electrical contact with the feeder line 150. Similarly, the outer conductor of the coaxial cable 140 makes electrical contact with the folded dipole 154 through the outer collar of a coaxial-to-microstrip transition 158.

Referring to FIG. 4, there is shown a partially see-through top view of the folded dipole antenna 100. As shown in FIG. 4, the folded dipole microstrip element generally indicated by the dashed outline 154 includes a continuous arm 162, as well as first and second arm segments 166 and 170. The first and second arm segments 166 and 170 define an excitation gap G which is spanned from above by the feeder line 150. In the preferred embodiment the folded dipole 154 excites the feeder line 150 across the excitation gap G, which results in an excitation signal being provided to receive electronics (not shown) of the paging receiver via the inner conductor 178 of the coaxial cable 140. In this regard the folded dipole 154 provides a ground plane for the feeder line 150, and is in direct electrical contact therewith through a wire connection 180 extending through the microstrip board 120.

The ground plane 110 (FIG. 3) operates as an antenna reflector to project electromagnetic energy radiated by the folded dipole 154. Specifically, ground plane 110 redirects such electromagnetic energy incident thereon in directions away from the receiver housing 40. Although in the preferred embodiment of FIG. 1 it is desired to maximize the radiation directed away from the receiver housing 40, in other applications it may be desired that the folded dipole antenna produce beam patterns in both vertical directions relative to the folded dipole 154. Accordingly, it is expected that in such other applications that the dipole antenna would be implemented absent a ground plane element.

In an exemplary embodiment the folded dipole 154 and feeder line 150 microstrip circuit elements are realized using a laminate board having a pair of copper-plated surfaces. Each surface is etched in order to produce copper profiles corresponding to the folded dipole and feeder line elements. Alternatively, these elements could be realized by directly plating both sides of a laminate board with, for example, gold or copper, so as to form the appropriate microstrip circuit patterns.

Figure 5A:
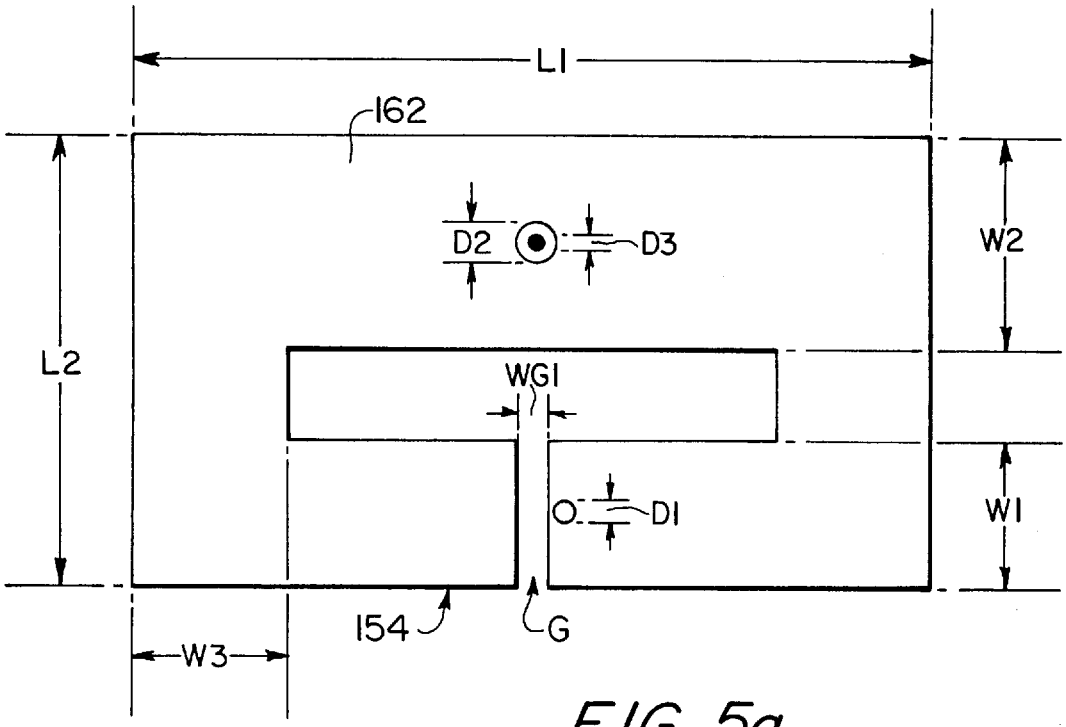
FIG. 5*a* provides a scaled representation of a folded dipole microstrip circuit element.
Figure 5B:
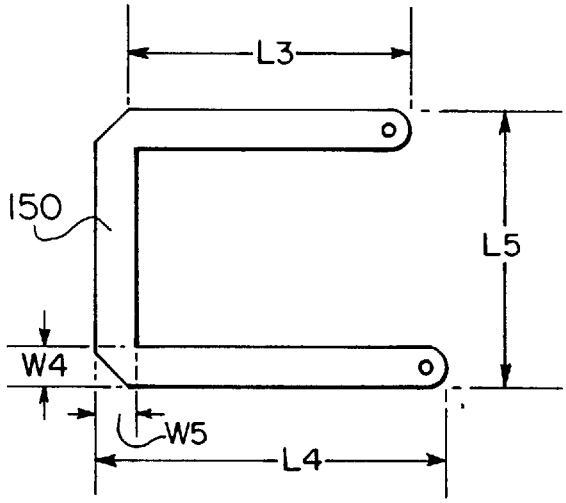
FIG. 5*b* provides a scaled representation of a feeder line microstrip circuit element.

FIGS. 5*a* and 5*b* provide scaled representations of the folded dipole 154 and feeder line 150 microstrip circuit elements, respectively. In the representation of FIGS. 5*a* and 5*b* the dimensions of the feeder line and dipole have been selected assuming an operational frequency of 1542 MHz and a laminate board dielectric constant of approximately 2.3. The dimensions corresponding to length (L), width (W), and diameter (D) parameters of the microstrip elements represented in FIG. 5 are set forth in the following table.

TABLE I

| Parameter | Dimension (mm) |
|---|---|
| L1 | 60 |
| L2 | 30 |
| W1 | 10 |
| W2 | 14 |
| W3 | 10 |
| D1 | 01 |
| D2 | 04 |
| D3 | 01 |
| WG1 | 02 |
| L3 | 25 |
| L4 | 27.5 |
| L5 | 18 |
| W4 | 4.7 |
| W5 | 4.7 |

It is noted that parameter D3 refers to the diameter of the circular aperture defined by the laminate board 20 through which extends the center conductor of coaxial cable 140. Similarly, the parameter D2 corresponds to the diameter of a circular region of the continuous dipole arm 162 from which copper plating has been removed proximate the aperture specified by D3. This plating removal prevents an electrical short circuit from being developed between the center coaxial conductor and the folded dipole 154. In the preferred implementation an end portion of the center coaxial conductor is soldered to the microstrip feeder line 150 after being threaded through the laminate board 120 and the dipole arm 162.

One feature afforded by the present invention is that the overall size of the dipole antenna may be adjusted to conform to the dimensions of the paging receiver housing through appropriate dielectric material selection. For example, the microstrip circuit dimensions given in TABLE I assume an implementation using Duroid laminate board having a dielectric constant of approximately 2.3. A smaller folded dipole antenna could be realized by using a laminate board consisting of, for example, a thin alumina substrate.

Referring again to FIG. 3, it is observed that the separation between the folded dipole 154 and the ground plane 110 is determined by the thickness T of the foam spacer 130. The thickness T and dielectric constant of the foam spacer 130 are selected based on the desired impedance to be presented by the folded dipole antenna. For example, in the preferred embodiment it is desired that the impedance of the folded dipole antenna be matched to the 50 ohm impedance of the coaxial cable 140. As is described below, one technique for determining the appropriate thickness T of the foam spacer

130 contemplates estimating the driving point impedance of the folded dipole antenna. Such an estimate may be made using, for example, a graphical representation of antenna impedance such as that depicted in FIG. 6.

In particular, FIG. 6 is a graph of the impedance of a conventional ½ wavelength dipole antenna situated horizontally above a reflecting plane, as a function of the free-space wavelength separation therebetween. As is indicated by FIG. 6, the impedance for large separation distances is approximately 73 ohms, and is less than 73 ohms if the dipole is situated close to (e.g., less than 0.2 wavelengths) and parallel with a reflecting plane. A folded ½ wavelength dipole exhibits an impedance approximately four times greater than the impedance of a conventional ½ wavelength dipole separated an identical distance from a reflecting plane. Accordingly, the separation required to achieve an impedance of 50 ohms using a folded dipole is equivalent to that necessary to attain an impedance of 12.5 ohms using a conventional ½ wavelength dipole. In order to use FIG. 6 in estimation of the impedance of a folded dipole separated from a reflecting plane by a dielectric spacer the free-space separation distance must be further reduced by the factor $1/\sqrt{\epsilon}$, where $\epsilon$ denotes the dielectric constant of the spacer.

Thus, in accordance with FIG. 6, the separation required to achieve an impedance of 50 ohms for a folded ½ wavelength dipole, using a dielectric space with a dielectric constant of approximately 1.2 would be approximately $(1/\sqrt{1.2})\times 0.075$ wavelengths, or approximately 0.07 wavelengths. Thus, the present invention allows the use of a relatively thin dielectric spacer.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A folded dipole antenna comprising:

a dielectric substrate defining a first surface and a second surface substantially parallel to said first surface;

a folded dipole element on said second surface, said folded dipole element including a continuous dipole arm, a first dipole arm segment and a second dipole arm segment, said first and second dipole arm segments being separated by an excitation gap, said continuous dipole arm being parallel to said first and second dipole arm segments;

a feed element on said first surface, said feed element being mounted in alignment with said excitation gap and being electrically connected to one of said first and second dipole arm segments;

a ground plane, said dipole element being positioned between said feed element and said ground plane; and a dielectric spacer interposed between said ground plane and said substrate to electrically isolate said second surface of the substrate from the ground plane and to support the substrate in a position spaced from the ground plane.

2. The antenna of claim 1, wherein said feed element comprises a microstrip feed line.

3. The antenna of claim 1, further comprising a coaxial cable extending through said dielectric spacer, said cable having a center conductor electrically connected to said feed element and an outer conductor electrically connected to said dipole element.

4. The antenna of claim 3, wherein thickness of said dielectric substrate is of a thickness selected such that the impedance presented by said antenna to said coaxial cable is approximately fifty ohms.

* * * * *